United States Patent [19]

Wallach

[11] 4,369,641

[45] Jan. 25, 1983

[54] TIMELOCK DEVICE

[76] Inventor: Erich Wallach, 1615 St-Jean Baptiste, St-Roch Comté Verchères, Quebec, Canada, J0L 2R0

[21] Appl. No.: 170,173

[22] Filed: Jul. 18, 1980

[30] Foreign Application Priority Data

Jul. 19, 1979 [CA] Canada ..... 332116

[51] Int. Cl.[3] ..... E05B 43/00

[52] U.S. Cl. ..... 70/272; 70/267; 70/448

[58] Field of Search ..... 70/272–274, 70/267–270, 443, 448

[56] References Cited

U.S. PATENT DOCUMENTS 3,877,261 4/1975 Robins ..... 70/448 X
4,062,210 12/1977 Uyeda ..... 70/272 X
4,137,738 2/1979 Marold ..... 70/274
4,269,050 5/1981 Bechtiger et al. ..... 70/272

*Primary Examiner*—William E. Lyddane
*Attorney, Agent, or Firm*—Schwartz, Jeffery, Schwaab, Mack, Blumenthal & Koch

[57] ABSTRACT

A timelock device comprising a mounting plate fixed at a location where the device is to be used, and a separate housing provided with a channel defining a passageway for the locking bolt of a door vault lock. The housing carries a locking pin, a timer and a mechanism operable by the timer means for moving the locking pin through the channel. Fastening means are used for detachably connecting the housing to the mounting plate. This device is particularly interesting since it allows for easy and accurate replacing of the operational parts of the device by replacement parts when the operational parts must be serviced.

5 Claims, 8 Drawing Figures

TIMELOCK DEVICE

The present invention relates to an improved timelock device.

Timelock devices are employed on the doors of vaults, or other security areas, to prevent unlocking of the main lock or locks on the door until a predetermined time has elapsed. When a bank vault door is locked for the weekend for example, a timelock device is employed to prevent operation of the door lock, to unlock the door, until the end of the weekend.

The timelock device is normally mounted on the inside of the vault door and is manually set to open at a predetermined time before the door is closed. The door is then locked from the outside, with the door lock moving a locking bolt, associated with the vault door lock, to a locking position within the timelock device. In this locking position, a locking pin in the timelock device presents movement of the locking bolt to an unlocking position until the set time has elapsed. Thus, the door lock cannot be operated. At the end of the set time period however, the timelock device moves the locking pin to unlock the locking bolt and to allow the lock mechanism of the door to be operated to unlock the door.

A common drawback of most of the known timelock devices lies in that they require frequent servicing, particularly with respect to their timer mechanisms, in order to ensure proper functioning. This entails frequent service visits by specialized servicemen, which is expensive, particularly when the vaults are located far away from the service center areas.

In order to overcome this drawback, it has already been proposed to remove the timelock devices when they need servicing and to replace them by replacement timelock devices while they are being serviced so that the door lock may stay operational. The removed timelock devices could be shipped to the service centers, which is cheaper than sending a serviceman for repairing the devices. However, problems often arise in aligning the replacement device with the locking bolt to ensure proper operation, because the replacement timelock device generally does not fit in the mounting holes in exactly the same way as the original timelock device and as a result, the locking pin does not cooperate properly with the locking bolt.

It is the purpose of the present invention to provide an improved timelock device, the operational parts of which can be easily and accurately replaced by corresponding replacement parts to improve servicing of the device.

Thus, in accordance with the present invention, only a portion of the timelock device is replaced for servicing. In particular, the mounting parts of the device are not moved when the operational parts are removed for servicing.

This immovability of the mounting parts of the device advantageously allows for accurate location of the replacement operational parts mounted to it and thus avoids or at least minimizes, misalignment problems with the locking bolt.

The timelock device according to the invention comprises a first fixed part, a second detachable part, and means for detachably mounting the second part onto the first part. The first part comprises a base member and means for mounting the base member at a location where the device is to be used. The second part comprises a housing with a channel in its back, a locking pin and a timer carried by the housing, and a mechanism operated by the timer for moving the locking pin through the channel.

The base member closes the channel when the housing is detachably mounted on the base member to define therewith a passageway for a locking bolt, and the locking pin, when moved into the channel, blocks passage of the locking bolt through the passageway, the timer being operable to withdraw the locking pin from the channel after a predetermined period of time.

The present invention will now be better understood with reference to the following description made in connection with the accompanying drawings in which.

Figure 1:
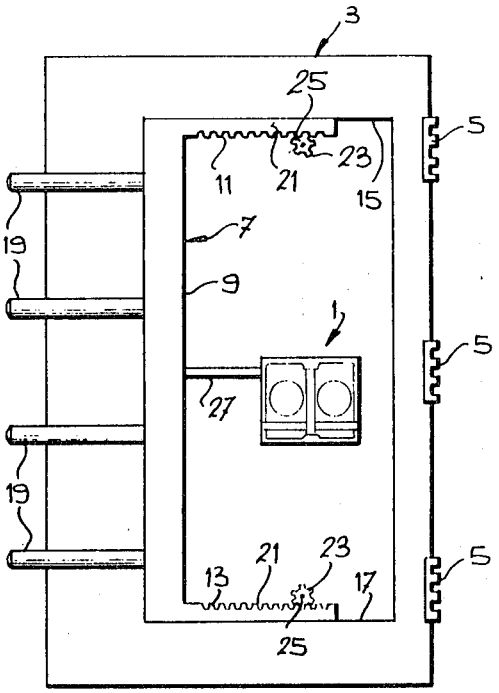
FIG. 1 is an elevation view showing a first embodiment of the timelock device according to the invention mounted on a door.
Figure 6:
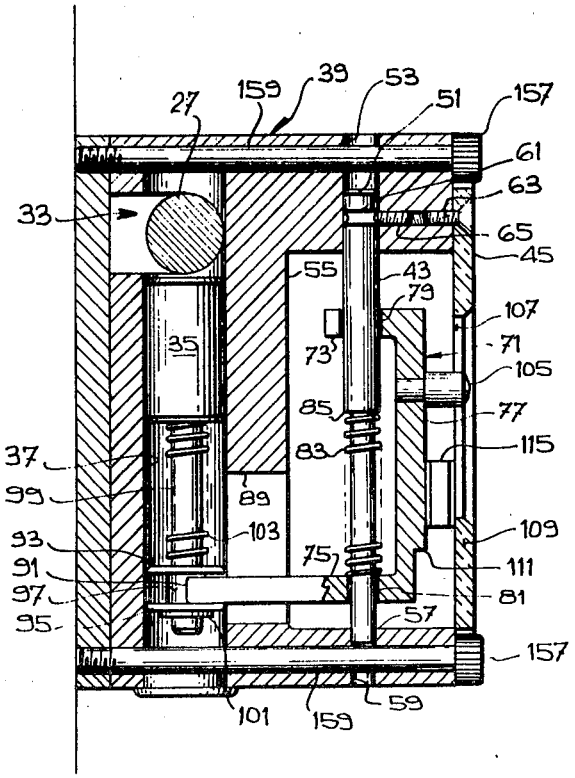
Figure 2:
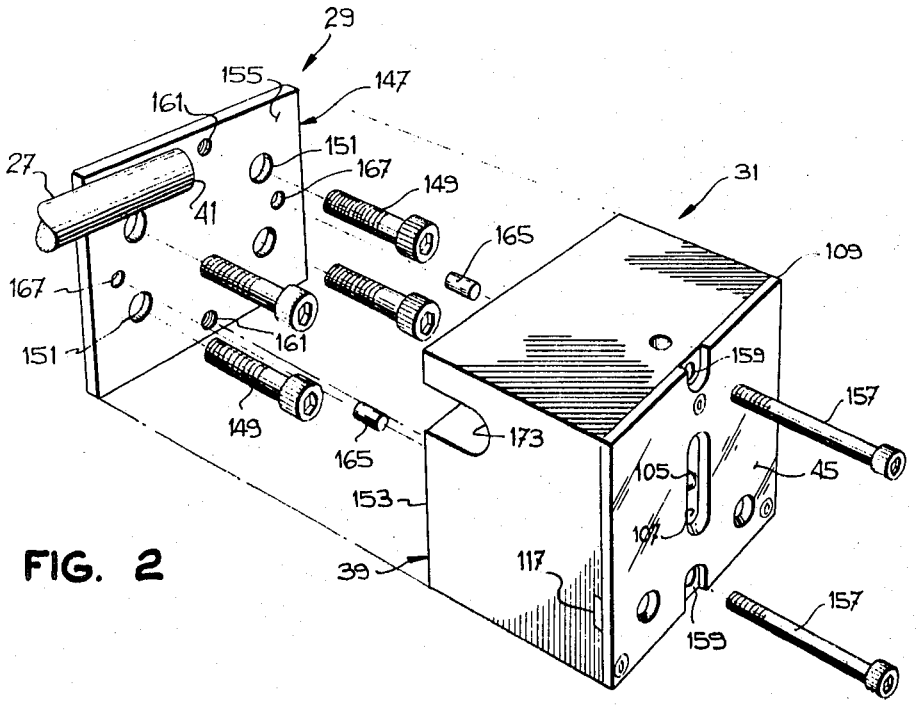
FIG. 2 is an exploded, perspective view of the timelock device shown in FIG. 1.
Figure 8:
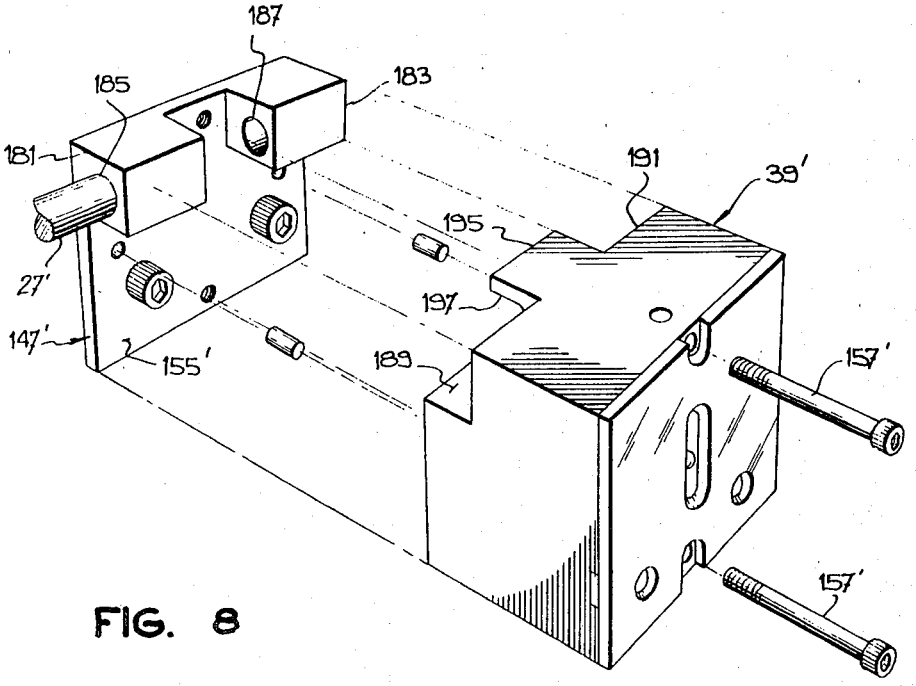
Figure 7:
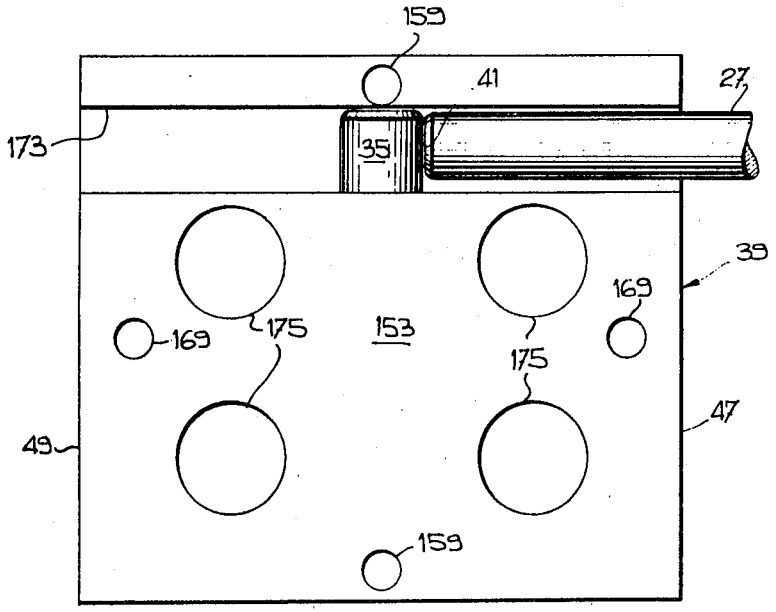

FIG. 6, appearing on the same sheet of drawings as FIG. 1, is a cross-sectional side view showing details of the locking pin and its operating mechanism;

FIG. 7 is a rear view of the housing of the timelock device of FIG. 1; and FIG. 8, appearing on the same sheet of drawings as FIG. 2, is an exploded perspective view of another embodiment of the timelock device according to the invention.

The timelock device 1 shown in FIG. 1 is mounted on the back, or interior, side of a vault door 3 which is swingably mounted in the wall of a vault (not shown) by a set of hinges 5. It could however be mounted on other security doors or structures as well.

Door locking means are also mounted on the interior side of the door 3. These locking means includes a support frame 7 slidably mounted on the door, which support frame 7 comprises a vertical member 9 and top and bottom horizontal members 11 and 13. The horizontal members 11 and 13 are guided along top and bottom horizontal rails 15 and 17, which are mounted on the door. A set of locking pins 19 are mounted on the vertical member 9. These pins 19 extend horizontally from the member 9 and project past the edge of the door 3 into corresponding recesses provided in the door frame (not shown) of the vault to lock the door when the support 7 is moved to the left when viewing FIG. 1.

The frame 7 is usually moved along the rails 15 and 17 by rack and pinion means 21 and 23. The racks 21 are provided on one side of each horizontal member 11 and 13 of the support frame 7. The pinions 23 are provided on the door adjacent each rack 21 to cooperate with it. Each pinion 23 is mounted on a shaft 25 which extends through the door up to the side thereof. Handles, (not shown) are connected to the shafts 25 on the exterior side of the door. Accordingly, when the handles are rotated, the support frame 7 may be moved to lock or unlock the door with the pins 19. This locking arrangement is known.

The support frame 7 also carries a locking bolt 27 which extends horizontally from the vertical frame member 9 in a direction opposite to the locking pins 19. The locking bolt 27 cooperates with the timelock device 1 to prevent movement of the support frame 7 in an unlocking direction from the locked position, when the timelock device 1 is in operation, so as to prevent opening of the door.

The timelock device 1 of FIG. 1, is made in two basic parts 29 and 31, as best shown in FIG. 2. The first part 29 is used for mounting the device, and will be described later. The second part 31 which comprises a housing 39, is detachably mounted to the first part 29. The first and second parts 27 and 31 together define a passageway 33, as shown in FIG. 6, through which the locking bolt 27 normally passes to allow the door to be unlocked. A locking pin 35 is movably mounted within a bore 37 located in the housing 39 of the second part 31 of the device. The bore 37 intersects the passageway 33, and the pin 35 is movable from the bore 37 into the passageway 33 to block movement of the locking bolt 27 through the passageway and thus to prevent unlocking of the door. Normally, when the door 3 is locked, the free end 41 of the bolt 27 lies adjacent the bore 37.

The pin 35 is normally spring-biased to remain in the bore 37 out of the passageway 33. Means are provided however, within the housing 39, for manually moving the pin 35 against the spring force into the passageway 33 to block movement of the bolt 27. These moving means as shown in FIG. 6 include a support post 43 near the front face 45 of the housing 39. The post 43 is centered between the sides 47 and 49 of the housing 39 and is parallel to the bore 37. The top end 51 of post 43 is mounted in a bore 53 passing through the main frame 55 of the housing 39 while in lower end 57 is mounted in a bore 59. The upper end 51 of the post 43 has a bevelled groove 61. A locking screw 63, accessible from the front face 45 of the housing 39 is inserted into a threaded bore 65 passing through the frame 55 and intersecting the bore 53. The tip of the screw 63 fits into the groove 61 to lock the post 43 within the frame 55.

A yoke 71 is slidably mounted on the post 43 as shown in FIG. 6. The yoke 71 has a short upper arm 73 and a long lower arm 75, parallel to the upper arm 73. The arms 73, and 75 are perpendicular to the post 43 and are joined by a vertical section 77 which extends parallel to the post 43. A bore 79 in the arm 73 and a bore 81 in the arm 75 loosely receive the post 43. A compression spring 83 is mounted on the post 43 between a shoulder 85 on the post, below the arm 73, and the top of the bottom arm 75. The bottom arm 75 extends rearwardly through a slot 89 in the frame 55 and into the bore 37. The free end 91 of the arm 75 is mounted between a pair of flanges 93 and 95 on a collar 97 which is slidably mounted on a stem 99 extending down from the bottom end of pin 35. A washer 101 at the bottom end of stem 99 retains the collar 97 on the stem. A compression spring 103 is mounted on the stem 99 between the top flange 93 on the collar 97 and the bottom end of pin 35.

A manipulative pin 105 projects outwardly from the vertical section 77 of the yoke 71 through a slot 107 in the front cover plate 109 of the housing 39. The bottom, front portion of the vertical section 77 of the yoke 71 is undercut to provide a stop shoulder 111 near its bottom end.

Figure 3:
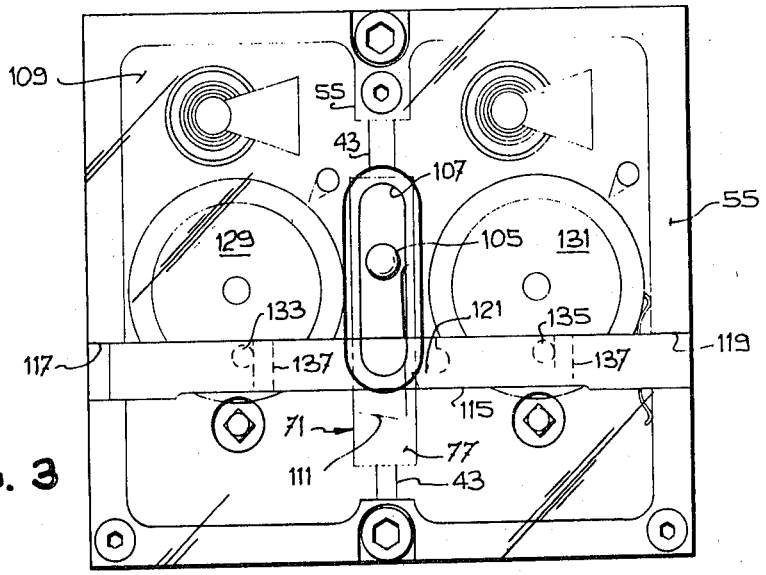
FIG. 3 is a front view of the timelock device shown in FIGS. 1 and 2.
Figure 4:
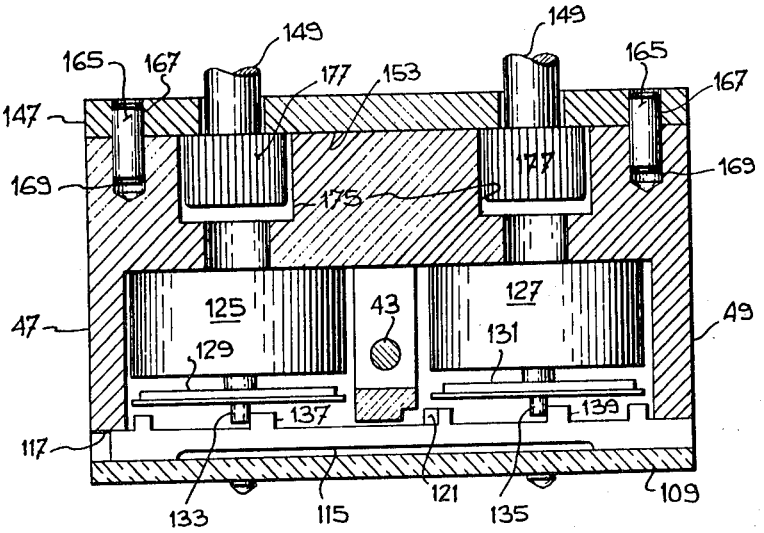
FIG. 4 is a cross-sectional top view of the timelock device of FIGS. 1, 2 and 3, showing timer and mounting details.
Figure 5:
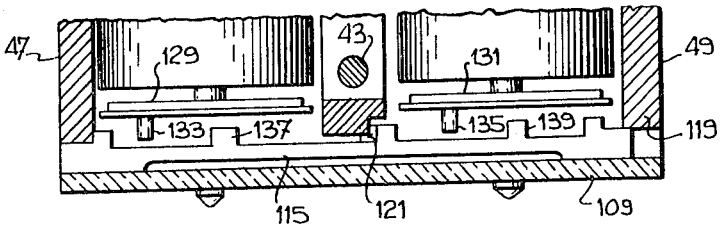
FIG. 5 is a cross-sectional top view similar to FIG. 4.

Referring now more especially to FIGS. 3 to 5, a horizontal locking bar 115 is slidably mounted in slots 117 and 119 passing through the main frame 55. This bar 115 passes in front and adjacent to the yoke 71. A stop 121 is located on the back of bar 115. The stop 121 is adjacent the yoke 71, when the bar 115 is in an unlocked position, to the right as seen viewing FIG. 3 or 4.

When moving the pin 105 up, the yoke 71 is raised against the force of the spring 83 and the pin 35 is biased into the passageway 33 where it can lock the bolt 37 against movement. With the yoke 71 raised, the locking bar 115 can be moved to the left as seen in FIG. 5 and the stop 121 will cooperate with the shoulder 111 to maintain the yoke 71, and thus the pin 35, raised. When the bar 115 is moved to the right, the stop 121 unlocks from the shoulder 111. The spring 83 then return the yoke 71 and pin 35 to a lowered position, unblocking movement of the bolt 27.

The housing 39 carries two identical timer devices 125 and 127, mounted on either side of the yoke 71. The timer devices 125 and 127 each carry a timer disk 129 and 131 respectively. Each timer disk 129 and 131 has a cam pin 133 and 135 on its front face, radially spaced from the center of rotation of the disk. A pair of cam bars 137 and 139 are provided on the back of the locking bar 115 for cooperating with the cam pins 133 and 135 respectively.

With the yoke 71 and pin 35 raised to a locking position, and with the locking bar 115 manually moved to lock the yoke 71 in its raised position, the timer disks 129 and 131 can be rotated to set the timers 125 and 127 in motion for a predetermined period. The cams 133, 135 are rotatably moved away from the bars 137 and 139 during the setting. As the timers 125 and 127 operate, the cams 133 and 135 are moved back toward the bars 137 and 139, and at the end of the timed period, contact these bars 137 and 139 and moved the locking bar 115 to the right to release the yoke 71 and lower pin 35. The timer devices 125 and 127 are designed to operate in tandem using suitable linkage means (not shown) so that if one fails, the other still operates to open the lock.

In accordance with the present invention, the first part 29 of the timing device 1 comprises a separate mounting plate 147 as shown in FIG. 2. The mounting plate 147 is mounted on the door 3 in a suitable position relative to the locking bolt 27, by a first set of mounting bolts 149 which pass through holes 151 provided into the plate 147. These mounting bolts 149 are threaded into corresponding mounting holes (not shown) drilled in the door 3.

The second part 31 of the device 1 is then mounted on the plate 147, via its housing 39. The back face 153 of the housing 39 is placed flush against the front fact 155 of the plate 147 and the housing 39 is detachably joined to the plate 147 by a second set of mounting bolts 157. The mounting bolts 157 pass through bores 159 in the frame 55 of the housing 39, from the front face 45 and out past the back face 153. The bolts 157 are screwed into threaded holes 161 provided in the plate 147, to securely the fasten housing 39 to the plate 147.

If desired, aligning means can be provided for accurately locating the housing 39 on the plate 147. Such accurate location is desirable to properly locate the pin 35 with respect to bolt 27. These aligning means, as shown in FIGS. 2 and 4, can comprise a pair of pins 165 fixedly mounted in holes 167 provided in the plate 147 which pins 165 project from the front face 155 of the plate 147, and a pair of receiving holes 169 provided in the housing 145 to receive the pins 165. Alternatively, the aligning pins 165 could be mounted on the housing 145 and the receiving holes 169 could be located on the plate.

A channel 173 is provided in the back wall 153 of the housing 39, extending across the width of the housing. The channel 173, together with the plate 147, form the through passageway 33 in which the locking bolt 27 is located. Recesses 175 shown in FIGS. 4 and 7 are also provided in the back wall 153 of the housing 39 to receive the heads 177 of the plate mounting bolts 149.

It can now be easily understood that the housing 39, which contains the parts of the device which need servicing such as the timers 125 and 127, the moving locking pin 35 or its operating mechanism, can be easily removed from the plate 147 and replaced by a new housing unit 39 which is accurately located with respect to the locking bolt 27. Only two bolts 157 need be removed to replace one housing 39 with another.

According to another embodiment of the invention shown in FIG. 8, the housing plate 147' can be provided with guide means for the locking bolt 27'. These guide means comprise a pair of spaced-apart, cubic projections 181 and 183. The projections 181 and 183 are formed integral with the plate 147' and project from the front face 155' thereof. The projections 181 and 183 are located at the upper corners of the plate and have aligned holes 185 and 187 respectively for slidably receiving the locking bolt 27'.

The housing 39' is formed with recesses 189 and 191 at its upper, back corners for receiving the cubic projections 181 and 183 so that, when the housing 39' and plate 147' are joined, a cubic timelock device is formed. The central portion 195 of the housing 39' between the recesses 189 and 191 has a channel 197 formed therein, similar to the channel 173. This channel 197 is aligned with the holes 185 and 187 in the cubic projections 181 and 183 when the housing 39' is fastened to the plate 147' with the bolts 157'. As before, the locking pin (not shown) intersects the channel 197. In this embodiment, the projections 181 and 183 of the plate 147' mate smoothly with the recesses 189 and 191 on the housing 39' to quickly and accurately locate the housing 39' on the plate and thus accurately locate the locking pin with respect to the locking bolt 27'.

The embodiments of the invention in which an exclusive property or privilege is claimed are defined as follows:

1. A timelock device comprising:

a first fixed part, said first part including a base member, and fastening means for mounting the base member at a location where the device is to be used;

a second detachable part, said second part including a housing, a channel in the back of the housing, a locking pin and a timer carried by the housing, and a mechanism operable by the timer for moving the locking pin through the channel; and fastening means for detachably mounting the second part to the first part;

wherein the base member closes the channel when the housing is detachably mounted on the base member to define therewith a passageway for a locking bolt, and the locking pin, when moved into the channel, blocks passage of the locking bolt through the passageway, the timer being operable to withdraw the locking pin from the channel after a predetermined period of time.

2. A timelock device as claimed in claim 1, further comprising cooperating aligning means on the base member and housing to properly position said housing on said base member when detachably mounting it thereon.

3. A timelock device as claimed in claim 2, wherein said aligning means comprise a pair of pins projecting from one of the housing and base member, and a pair of receiving recesses in the other of the housing and base member for receiving the pins.

4. A timelock device as claimed in claim 1, 2 or 3, further comprising recesses on the back of the housing on either side of the channel and locking bolt guide projections on the base member, said projections fitting in the recesses to align the locking bolt with the channel when the housing is detachably mounted on the base member.

5. A timelock device as claimed in claim 1, 2 or 3, wherein the mechanism operable by the timer for moving the locking pin through the channel includes an operating yoke connected to the locking pin and a locking bar slidably mounted through the housing for firmly blocking the yoke, said bar being operable by the timer to release the yoke and thus the locking pin.

* * * * *